US006042419A

United States Patent [19]

Liu

[11] Patent Number: 6,042,419

[45] Date of Patent: Mar. 28, 2000

[54] SECURING DEVICE FOR A JACK

[75] Inventor: Danny Liu, Taipei, Taiwan

[73] Assignee: Dan-Chief Enterprise Co., Ltd., Taipei, Taiwan

[21] Appl. No.: 08/867,931

[22] Filed: Jun. 3, 1997

Related U.S. Application Data

[63] Continuation-in-part of application No. 08/522,130, Aug. 31, 1995, abandoned.

[51] Int. Cl.[7] ..... H01R 13/73

[52] U.S. Cl. ..... 439/557

[58] Field of Search ..... 439/557

[56] References Cited

U.S. PATENT DOCUMENTS

| | | | |
|---|---|---|---|
| 4,731,925 | 3/1988 | Tanishi et al. | 439/557 |
| 5,106,325 | 4/1992 | Robinson et al. | 439/540 |
| 5,217,190 | 6/1993 | Reed et al. | 439/557 |
| 5,238,426 | 8/1993 | Arnett | 439/557 |
| 5,885,111 | 3/1999 | Yu | 439/941 |

*Primary Examiner*—Michael L. Gellner
*Assistant Examiner*—Briggitte Renee Hammond
*Attorney, Agent, or Firm*—Christie, Parker & Hale, LLP

[57] ABSTRACT

A securing device for securing on a panel a jack, wherein the panel has a window, an outer side and an inner side. The device includes: a plate having a hole for inserting a plug therethrough from the outer side of the panel into the jack located on the inner side of said panel; and an engaging means including two pieces extruding from one side of the plate, having thereon tenons respectively for positioning and securing the engaging means and the plate on the windows of the panel, and slots for engaging therein the at least one barb of the jack to secure the jack.

12 Claims, 10 Drawing Sheets

SECURING DEVICE FOR A JACK

FIELD OF THE INVENTION

This is a continuation-in-part application of U.S. patent application Ser. No. 08/522,130, filed on Aug. 31, 1995, now abandoned, and entitled SECURING DEVICE FOR JACK. The present invention relates to a securing device, and more particularly to a securing device for a jack.

BACKGROUND OF THE INVENTION

Previously, the jacks for telephone, computer and data network were directly mounted on a cover plate for the jack or on a patch panel. FIGS. 1(*a*), 1(*b*) and 1(*c*) show a jack 10 having two barbed pieces 12 and 15 (wherein the piece 12 is elastic) having on their tips an inclined surface 13 which engages the window 14 of the cover plate 11, where the jack 10 is inserted from the rear of the cover plate 11 and projects beyond the window 14 by sliding the inclined surface 13 therethrough to respectively stop the barbed pieces 12 and 15 on the window 14 so as to fix the jack in place as shown in FIG. 1(*a*), and the sectional assemblage is shown in FIG. 1(*b*). Such a structure has the following drawbacks:

1) The jack 10 will protrude over the cover plate surface especially when the plug 17 is secured into the jack 10, which causes much inconvenience in use and an untidy appearance as shown in FIG. 1(*b*).
2) The jack 10 and the through hole 14 of the cover plate 11 have therebetween a clearance 16 which prevents the jack 10 and the cover plate 11 from tightly engaging with each other and from keeping out dust or the other foreign matter as shown in FIG. 1(*c*).

Similarly, mounting a jack on a network patch panel will also exhibit the above-mentioned problems.

On the other hand, FIG. 2(*a*) shows a modified jack 23 to be secured on a square wall 22 by projecting into the window 21 of the cover plate 20, where the square wall 22 and the cover plate 20 are integrally formed. Further, corresponding to the respective barbed pieces 24 and 25 of the jack 23, the square wall 22 includes two traverse media 26 and 27 for securing the respective barbed pieces 24 and 25 so as to retain the jack 23 in position. Accordingly, this modification prevents the jack 23 from protruding over the cover plate surface and avoids the clearance therebetween, as shown in FIG. 2(*b*). But, such a structure cannot be applied on a patch panel because the patch panel is a metallic product which cannot be made with a wall around its window when pressed. Besides, this modified jack does not provide a color for identification and does not have a display hole containing therein a display plate for showing a functional attribute of the jack, which further limits its practical and commercial value.

Arnett (U.S. Pat. No. 5,238,426) discloses an adapter mounted on a panel plate to hold a jack. The adapter includes two parallel side portions and two moveable arms. To fix the adapter on the opening of the panel plate, each of the arms further includes two detents, and each of the parallel side portions further includes a depending portion. Furthermore, to engage the jack, the adapter further includes two grooves provided on the inner walls of the parallel side portions respectively for receiving therein the barbs of the jack. To remove the adapter from the panel plate, the user must apply force to the free end portions of the arms. Therefore, the free end portions of the arms must extrude from the front surface of the panel plate. The other problem of Arnett's device is that, it cannot be applied to the jack with barbs as shown in FIGS. 1(*a*) and 2(*a*), which is a popularly used type of jack.

SUMMARY OF THE INVENTION

An object of the present invention is to provide a securing device for firmly engaging a jack with a cover plate or a patch panel, preventing an over protrusion from the surface of the cover plate or the patch panel and avoiding a clearance between the jack and the cover plate or the patch panel.

Another object of the present invention provides an identification of the securing device with a color and/or a functional attribution of the securing device by a display plate.

The other object of the present invention provides a securing device able to be easily detachably secured for convenient management.

In accordance with the present invention, a securing device for securing on a panel a jack having at least one barb, the panel having a window, an outer side and an inner side, the device includes: a plate having a hole for inserting a plug therethrough from the outer side of the panel into the jack located on the inner side of the panel; and an engaging means including two pieces extruding from one side of the plate, having thereon tenons respectively for positioning and securing the engaging means and the plate on the windows of the panel, and slots for engaging therein the at least one barb of the jack to secure the jack.

In accordance with another aspect of the present invention, the plate and the engaging means are integrally formed.

In accordance with another aspect of the present invention, the panel has a hole, and the engaging means is secured on the hole of the plate.

In accordance with another aspect of the present invention, the plate is flexible.

In accordance with another aspect of the present invention, the two pieces are flexible.

In accordance with another aspect of the present invention, the two pieces are located parallelly and oppositely to each other.

In accordance with another aspect of the present invention, the plate is secured on the outer side of the panel, and the two pieces are extruding from the plate into the inner side of the panel.

In accordance with another aspect of the present invention, the plug is a computer network wire connector.

In accordance with another aspect of the present invention, the plug is a telephone wire connector.

In accordance with another aspect of the present invention, the plug is a BNC connector. A BNC connector is a kind of coaxial cable connector which is well known in the art.

In accordance with another aspect of the present invention, the plug is an ST (straight tip) fiber optic connector.

In accordance with another aspect of the present invention, the plug is an F-Type TV connector.

In accordance with another aspect of the present invention, the plate is provided with a display plate for an identification.

In accordance with another aspect of the present invention, the plate is provided with a display icon for identification.

In accordance with another aspect of the present invention, the plate is a specific color.

In accordance with another aspect of the present invention, the plate prevents foreign matter from being introduced through the panel.

In accordance with another aspect of the present invention, the jack is an insulation displacement connector Type Keystone Jack (IDC Type Keystone Jack).

In accordance with another aspect of the present invention, the panel is a plate cover for the jack.

In accordance with another aspect of the present invention, the panel is a patch panel.

In accordance with another aspect of the present invention, the securing device has a specific color.

The present invention may best be understood through the following description with reference to the accompanying drawings, in which:

DETAILED DESCRIPTION OF THE PREFERRED EMBODIMENT

Figure 1A:
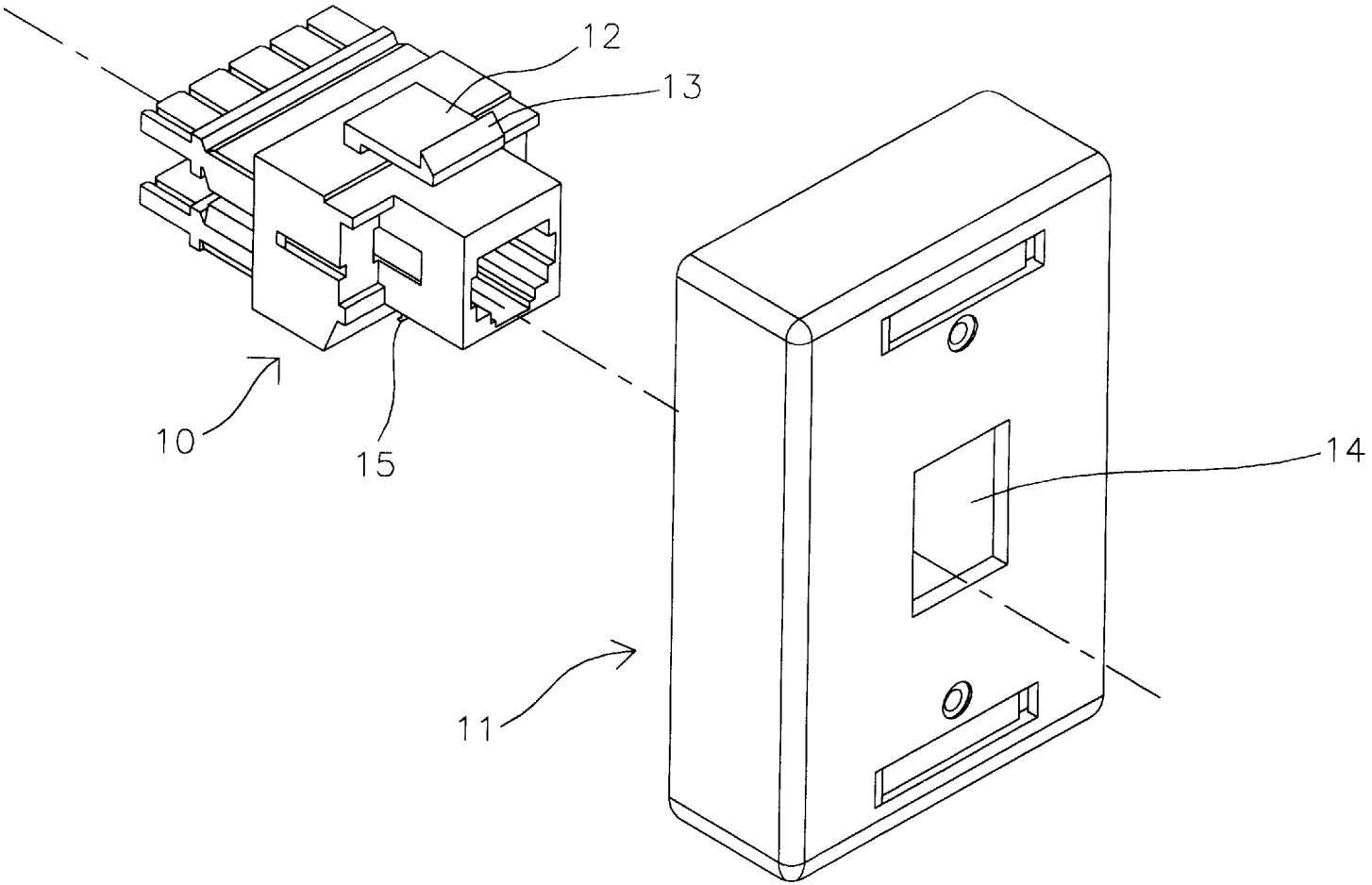
Fig. 1(a)(PRIOR ART)
FIGS. 1(*a*), 1(*b*) and 1(*c*) are an exploded view, an elevational view and a front view respectively showing an engagement of a jack and a prior cover plate.
Figure 1B:
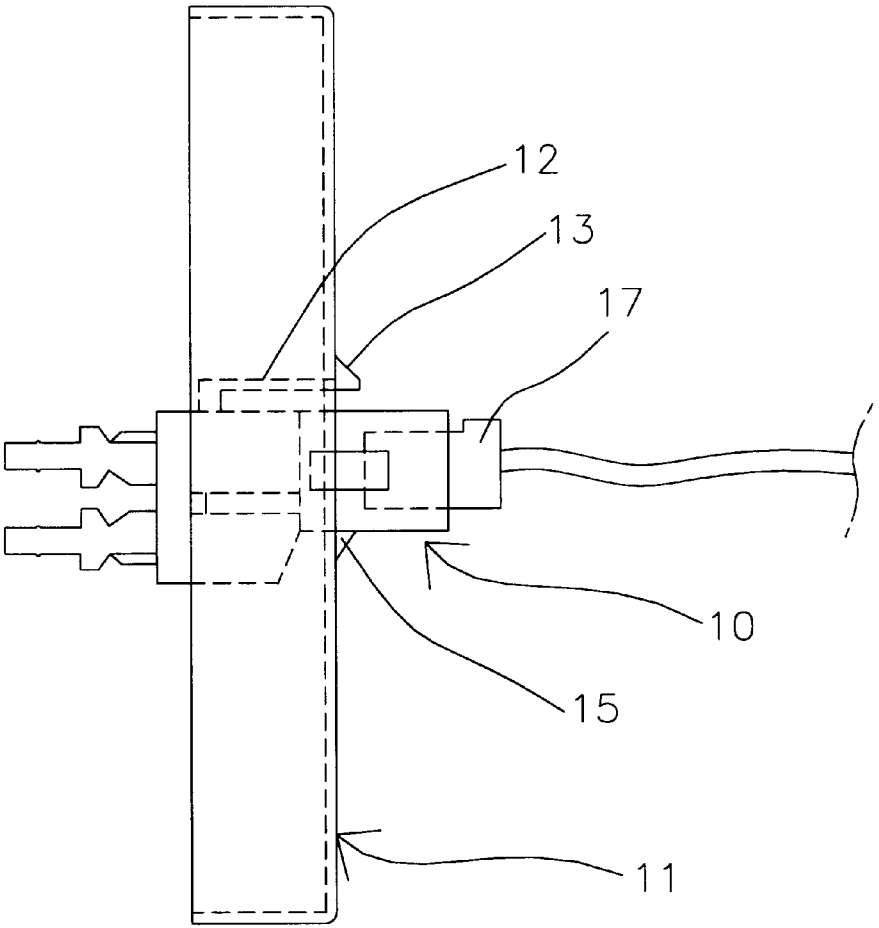
Fig. 1(b)(PRIOR ART)
Figure 1C:
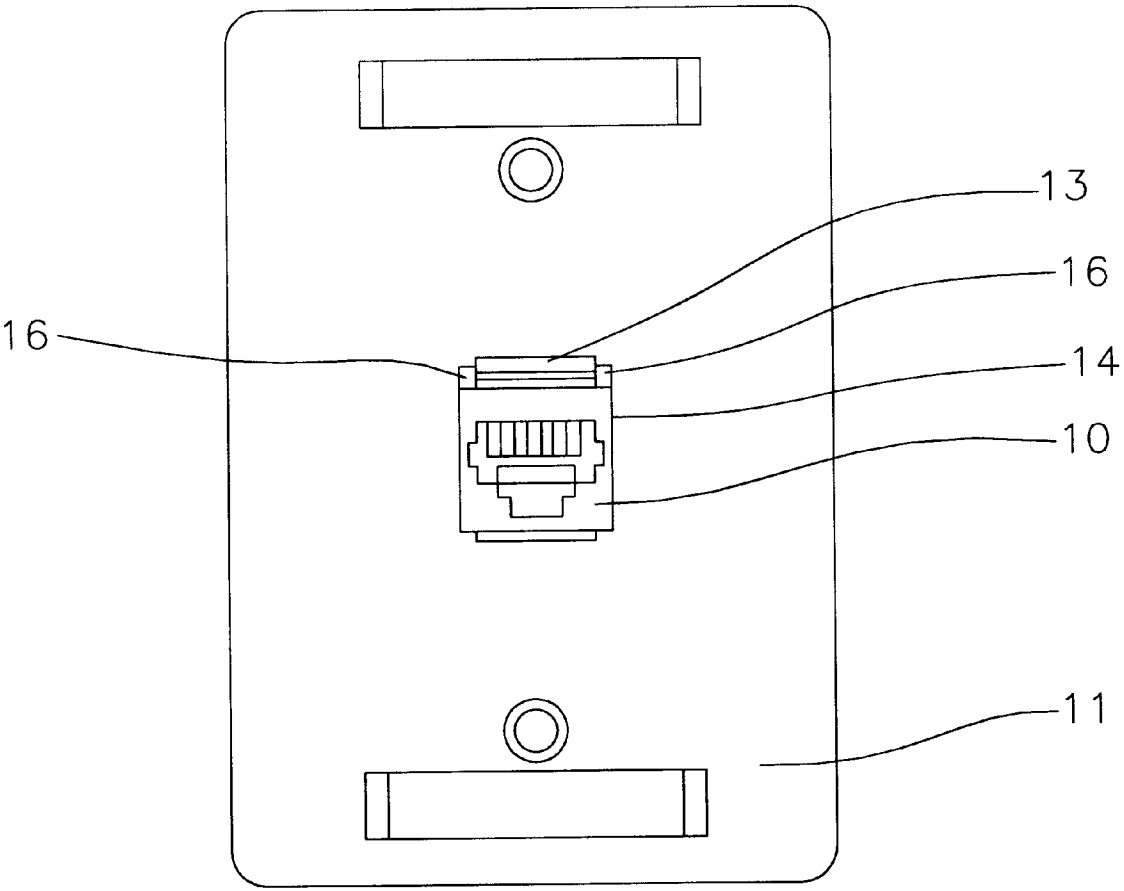
Fig. 1(c)(PRIOR ART)
Figure 2A:
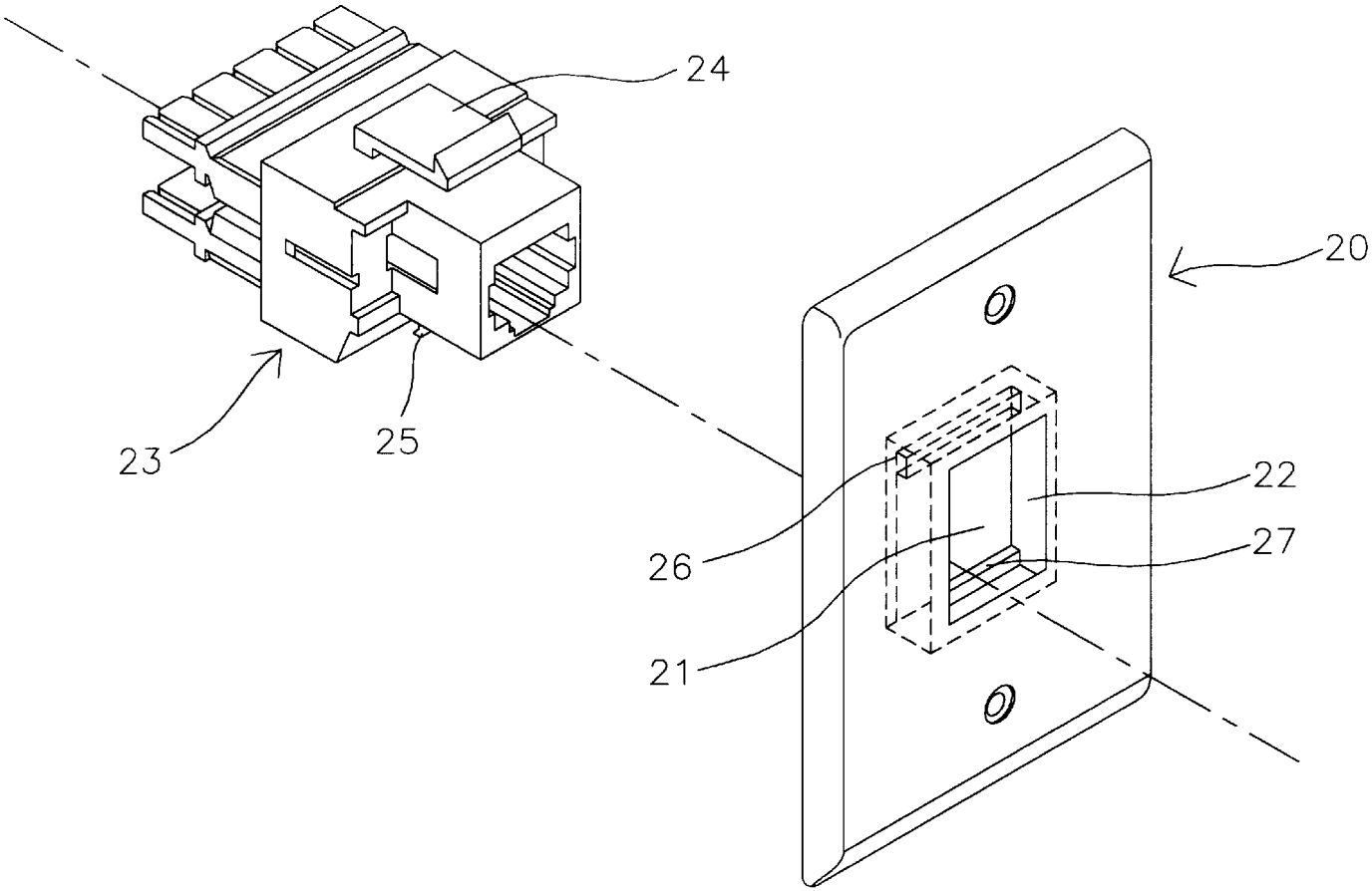
Fig. 2(a)(PRIOR ART)
FIGS. 2(*a*) and 2(*b*) are an exploded view and a front view respectively showing an engagement of a jack and a further prior cover plate.
Figure 2B:
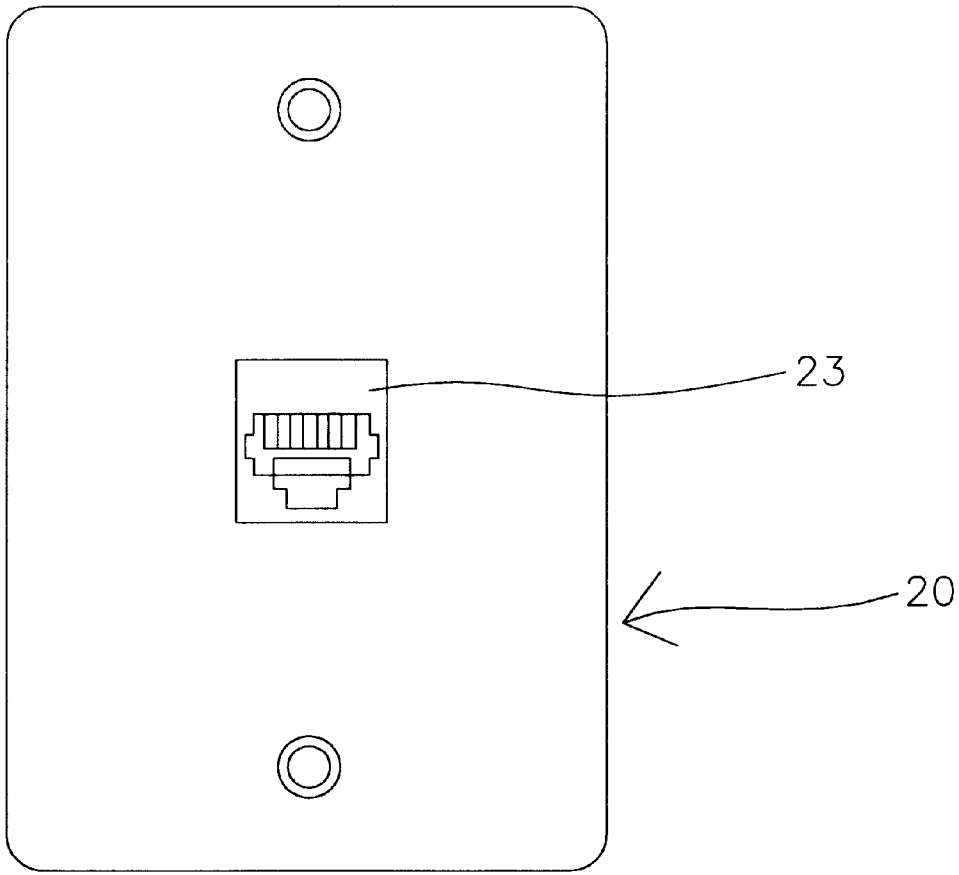
Fig. 2(b)(PRIOR ART)
Figure 3A:
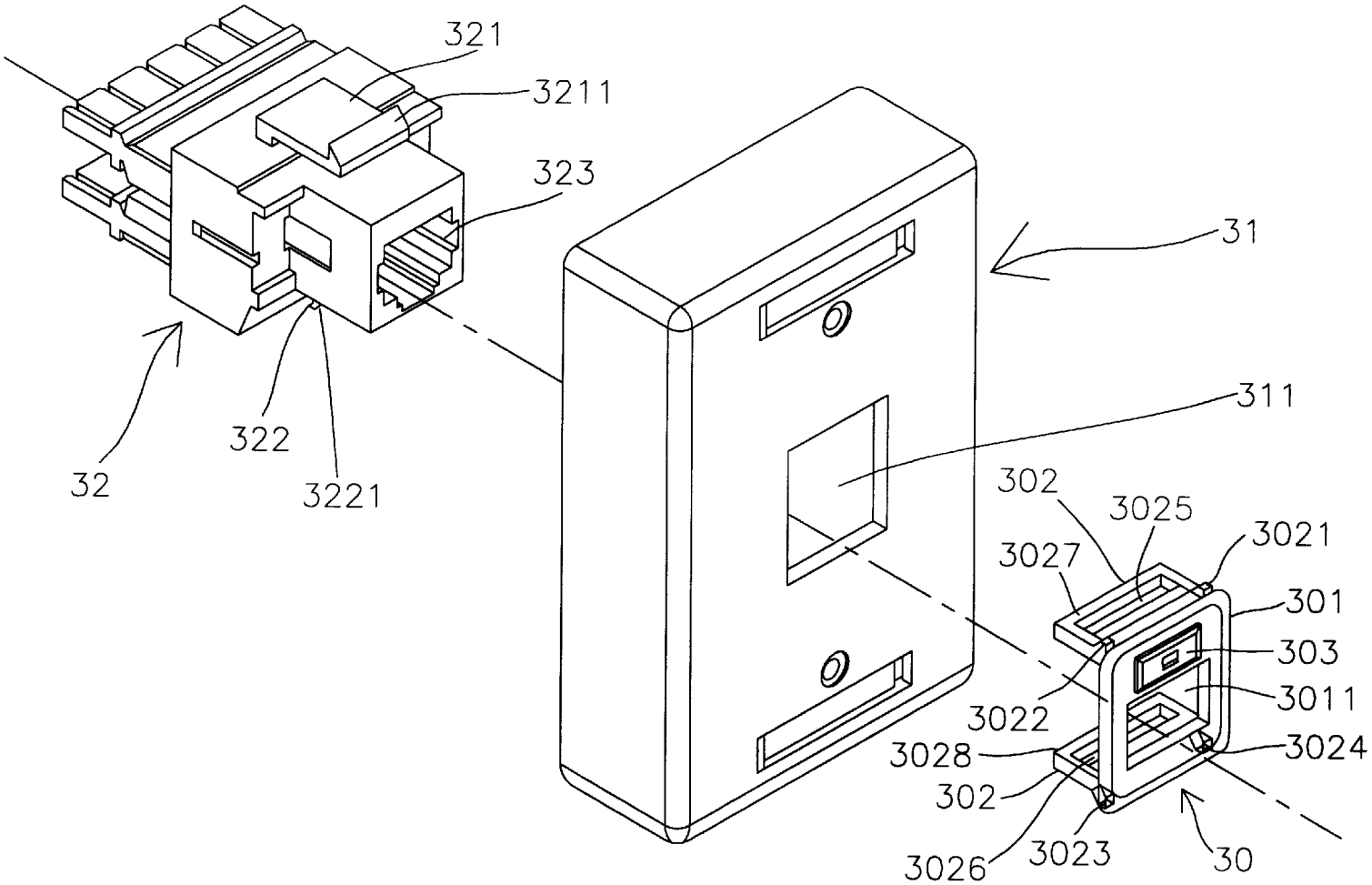
FIGS. 3(*a*) and 3(*b*) are an exploded view and a front view respectively showing an engagement of a jack and a preferred embodiment of a cover plate according to the present invention.
Figure 3B:
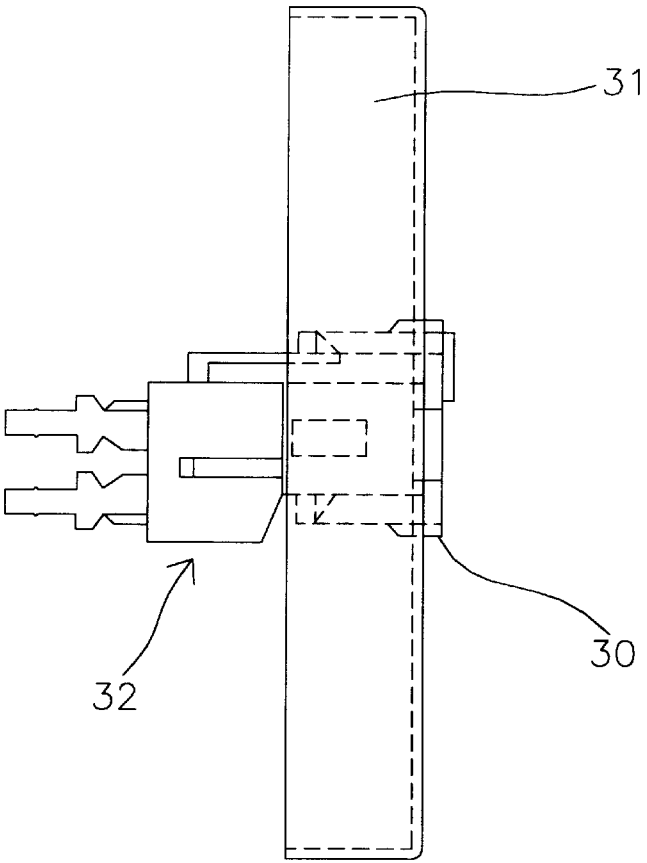

Referring to FIGS. 3(*a*) and 3(*b*), a securing device 30 engages a cover plate 31 and an insulation displacement connector type keystone jack 32 (IDC Type Keystone Jack). The securing device 30 includes a plate 301 and an engaging means 302. The engaging means 302 includes two pieces 3027 and 3028. The two pieces 3027 and 3028 extrude from one side of the plate 301, and are located parallely and oppositely to each other. There are tenons 3021, 3022, 3023 and 3024 and slots 3025 and 3026 distributed on the two pieces 3027 and 3028 respectively, as shown in FIG. 3(*a*). The four tenons 3021, 3022, 3023 and 3024 and the plate 301 secure the securing device 30 on the window 311 of the cover plate 31 when the engaging means 302 is inserted into the window 311. The jack 32, which is the same as the popularly-used-type jacks shown in FIGS. 1(*a*) and 2(*a*), has two barbed pieces 321 and 322 having on their tips an inclined surface 3211 (3221), and the barb 321 is elastic. Referring to FIG. 3(*b*), when the jack 32 comes in contact with the cover plate 31 from the rear of the cover plate 31, the barbed pieces 321 and 322 in turn engage with the engaging means 302 by sliding their inclined surfaces 3211 and 3221 into the respective slots 3025 and 3026 so as to secure the jack 32 in position. Further, the plate 301 has a through hole 3011 which correspondingly aligns with the jack hole 323 so as to receive therein a plug inserted from the through hole 3011. Preferably, beside the through hole 3011 there is provided a display plate 303 which may present a specific color or an icon for identification.

Figure 4:
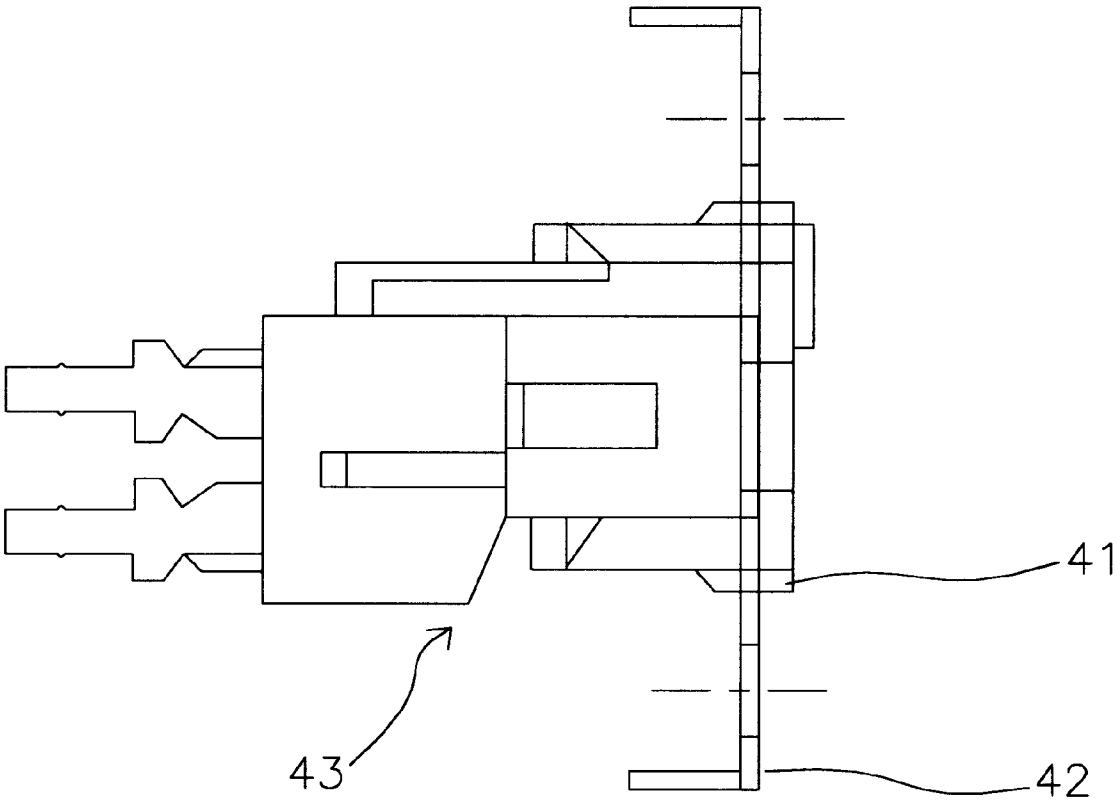
FIG. 4 is an elevational view schematically showing an engagement of a jack and a preferred embodiment of a patch panel according to the present invention.

It is notable that the two pieces 3027 and 3028 have two functions: securing the securing device 30 on the cover plate 31 and engaging the barbed pieces 321 and 322 of the jack 32 respectively. Referring to Arnet's adapter, the securing of the adapter is performed by two arms having detents respectively, and the engaging means are two grooves formed on the inner portion of the sidewalls of the adapter. To form the grooves for engaging, the adapter of Arnet must have large-area sidewalls. Furthermore, to connect the arms on the adapter, there is further need for two plastic hinges on the end portions of the sidewalls. In the present invention, both the securing and engaging functions are performed by the simple-structured two pieces 3027 and 3028. Accordingly, the cost of manufacturing the securing device of the present invention is lower than that of the adapter of Arnet because fewer elements and materials are needed. Similarly, the instant securing device 41 can be used for engaging a patch panel 42 and the relevant jacks 43 as shown in FIG. 4.

Figure 5A:
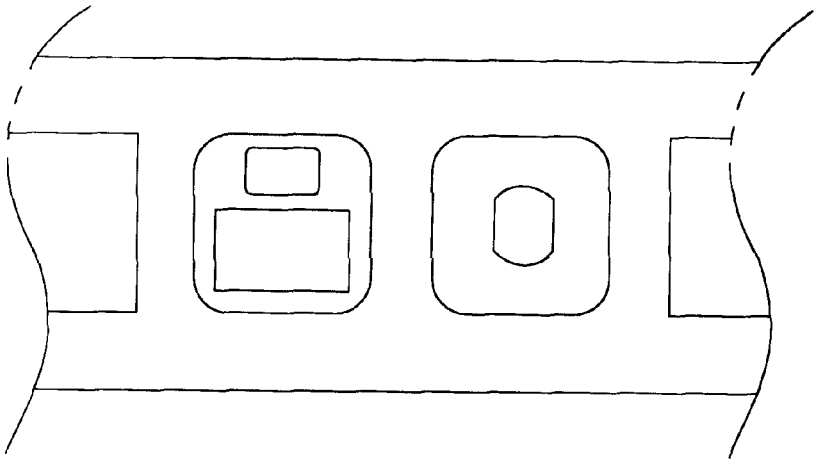
FIGS. 5(*a*) and 5(*b*) are front views respectively showing the present plate having a through hole and the present plate without a through hole according to the present invention.
Figure 5B:
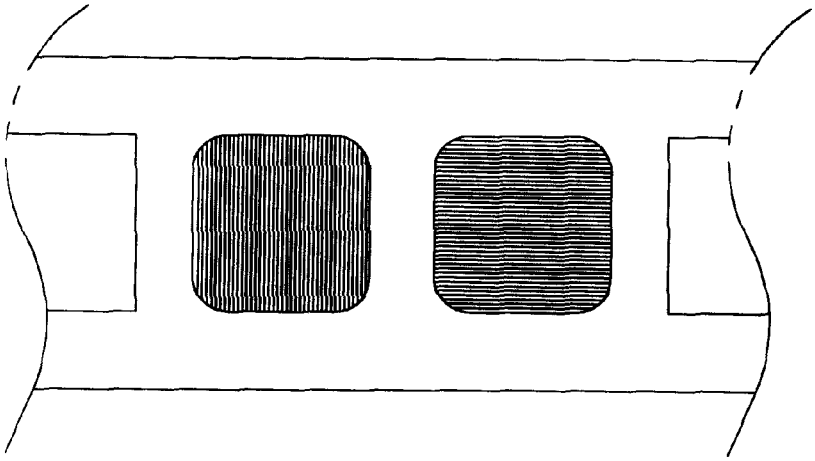
Figure 6E:
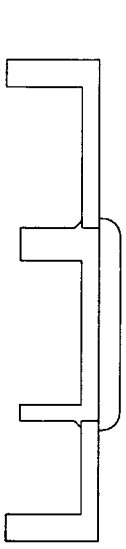
FIGS. 6(*a*)–6(*e*) illustrate a procedure for engaging a securing device according to the present invention onto a cover plate.
Figure 6D:
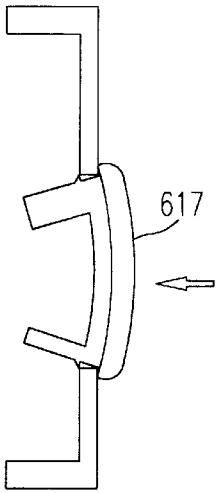
Figure 6C:
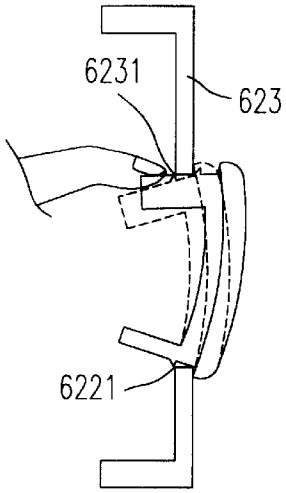
Figure 6B:
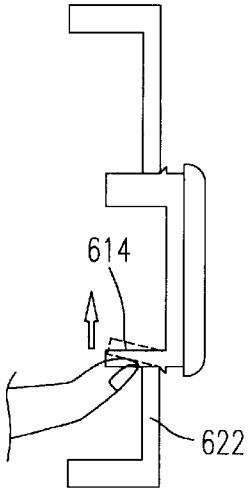
Figure 6A:
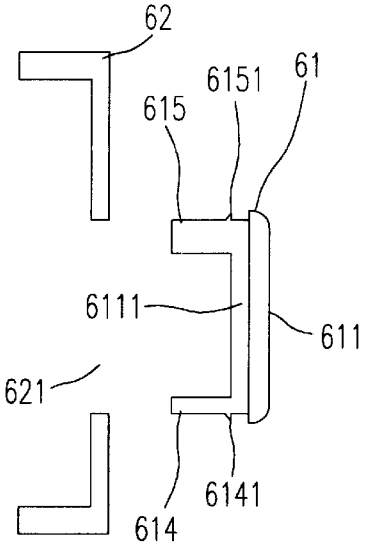

The present jack can not only engage an IDC Type Keystone Jack, but also receive different kinds of connectors such as BNC connector, ST fiber optic connector and F connector by changing only the shape of the through hole of the plate as shown in FIG. 5(*a*). On the other hand, the portion of the plate corresponding to the idle window of the cover plate or the patch panel may be a plain surface without any through hole for preventing dust or foreign matter from being introduced through the panel and for maintaining the fine appearance as shown in FIG. 5(*b*). Besides, the plate may have additional spaces for more jacks so as to overcome the shortcomings encountered by the prior patch panel having a standard number of fixed jacks.

The plate of the securing device of the present invention is flexible. Referring to FIG. 6(*a*), the plate 611 of the securing device 61 may have a reinforcing portion 6111 behind the plate 611 and between the two pieces 614 and 615 of the securing device 61, to increase the flexibility and the intensity of the plate 611. The procedures for mounting the securing device 61 on the window 621 of the panel 62 are illustrated in FIGS. 6(*a*)–6(*e*). In FIG. 6(*a*), the securing device 61 is inserted into the window 621. In FIGS. 6(*b*) and 6(*c*), the two pieces 614 and 615 are pushed inwardly respectively. Due to the flexibility of the plate 611 and the reinforcing portion 6111, the tenons 6141 and 6151 are stuck on the corner 6221 of the lower wall 622 and the corner 6231 of the upper wall 623 respectively. When the front surface 617 of the securing device 61 is pushed, as shown in FIG. 6(*d*), the tenons 6141 and 6151 will slide into the inner side of the panel 62. And then, as shown in FIG. 6(*e*), the two pieces 614 and 615 will return to their normal positions respectively because of the flexibility of the plate 611 and the reinforcing portion 6111.

It is then observed that, the flexibility of the plate 611 and the reinforcing portion 6111 must first be overcome thereby to detach the securing device 61 from the panel 62. Referring to Arnett's adapter, only the flexibility of the arms is available for resisting the detachment of the adapter. Therefore, the present invention provides a more reliable engagement between the securing device and the panel, since the body of the plate of the present invention can provide an elastic force larger than that of the arms of Arnett's adapter.

Moreover, the free ends of the arms of Arnett's adapter are extruding above the front surface of the panel and exposed at the outside of the panel. In addition to the unsightly of the extruding free ends of the arms, the exposed portion of the arms may easily be broken by any unexpected external force. On the other hand, the two pieces 614 and 615 are inserted into the inner side of the panel plate 62, and therefore, they will not protrude from the outer surface of the panel plate 62, and only the plate 611 is flattened on the outside of the panel plate 62. Therefore, the securing device of the present invention is not only more tasteful in appearance but also safer in using compared to Arnett's adapter.

From the above discussion, the present securing device has the following advantages:

1) It can be mounted on a cover plate, a network patch panel or other media suitable for similar purposes, and can be easily detached/attached for convenient management.
2) It keeps a plain surface for the patch panel or the cover plate so that the jack does not protrude therefrom to in turn cause inconvenience in use when mounted on the cover plate or on the network patch panel, and it covers the idle windows of the cover plate to enhance a fine appearance.
3) It leaves no clearance under the tight engagement of the jack and the cover plate, the patch panel or other media suitable for similar purposes so as to prevent dust and/or foreign matter from being introduced through the panel.
4) It may present a specific color for convenient identification; for example, a network system may include a plurality of jacks having different colors for conveniently identifying the respective sections, area or departments, etc., where they are connected.
5) It has a display plate or a display icon for easily identifying its functional attribute.
6) It can not only engage with an IDC Type Keystone Jack, but also accept different kinds of connectors such as a BNC connector, ST fiber optic connector and F connector.

To sum up, the instant invention rectifies the drawbacks of the prior jacks by adding a securing device for detachably securing the jack on the cover plate or the patch panel, and by providing a display plate for identifying the functional attribute of the jack and presenting a color for identification; which is a creative device and has high practical and commercial values.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A securing device for securing on a panel, a jack having at least one barb, said panel having a window, an outer side and an inner side, said device comprising:

a plate having a hole for inserting a plug therethrough from said outer side of said panel into said jack located on said inner side of said panel; and an engaging means including:

two pieces extending from one side of said plate, having thereon tenons respectively for positioning and securing said engaging means and said plate on said window of said panel, and a slot formed on at least one of said two pieces for engaging therein said at least one barb of said jack to secure said jack, wherein said plate is flexible allowing the plate to be bent thereby allowing said tenons to pass through said window when mounting said securing device to said plate.

2. A securing device according to claim 1 wherein said plate and said engaging means are integrally formed.

3. A securing device according to claim 1 wherein said two pieces are located parallelly and oppositely to each other.

4. A securing device according to claim 1 wherein said plate is secured on said outer side of said panel, and said two pieces are extruding from said plate into said inner side of said panel.

5. A securing device according to claim 1 wherein said plate is provided with a display plate for an identification.

6. A securing device according to claim 1 wherein said plate is provided with a display icon for an identification.

7. A securing device according to claim 1 wherein said plate comprises a color for an identification.

8. A securing device according to claim 1 wherein said plate prevents a foreign matter from being introduced through said panel.

9. A securing device according to claim 1 wherein said securing device has a color for an identification.

10. A securing device according to claim 1 wherein said plate further includes an reinforcing portion distributed between said two pieces.

11. The securing device according to claim 1 wherein said two pieces comprises a slot for engaging therein another barb of said jack.

12. A securing device securing on a panel, a jack having at least one barb, said panel having a window, an outer side and an inner side, said device comprising:

a plate having a hole for inserting a plug therethrough from said outer side of said panel into said jack located on said inner side of said panel;

two pieces extending from one side of said plate, having thereon tenons respectively to position and secure said two pieces and said plate on said window of said panel; and a slot formed on at least one of said two pieces engaging therein said at least one barb of said jack to secure said jack, wherein said plate is flexible allowing the plate to be bent thereby allowing said tenons to pass through said window when mounting said securing device to said plate.

* * * * *